US007850054B2

(12) United States Patent
Shimizu et al.

(10) Patent No.: US 7,850,054 B2
(45) Date of Patent: Dec. 14, 2010

(54) STAPLER WITH A MECHANISM FOR CUTTING STAPLE LEGS

(75) Inventors: Toshio Shimizu, Tokyo (JP); Kazuhiko Kishi, Tokyo (JP); Katsuya Hakozaki, Tokyo (JP); Kazuo Higuchi, Tokyo (JP); Katsunori Manabe, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 11/632,549

(22) PCT Filed: Jul. 12, 2005

(86) PCT No.: PCT/JP2005/012858

§ 371 (c)(1),
(2), (4) Date: Jan. 17, 2007

(87) PCT Pub. No.: WO2006/009017

PCT Pub. Date: Jan. 26, 2006

(65) Prior Publication Data

US 2008/0035699 A1 Feb. 14, 2008

(30) Foreign Application Priority Data

Jul. 20, 2004 (JP) ..... 2004-212338

(51) Int. Cl.
*B27F 7/23* (2006.01)

(52) U.S. Cl. ..... 227/79; 227/76; 227/155; 227/156

(58) Field of Classification Search ..... 227/79, 227/76, 155, 156
See application file for complete search history.

(56) References Cited

U.S. PATENT DOCUMENTS

| | | | | |
|---|---|---|---|---|
| 4,378,085 | A * | 3/1983 | McVeigh | 227/79 |
| 4,844,319 | A * | 7/1989 | Kurosawa | 227/79 |
| 5,583,628 | A * | 12/1996 | Parks | 399/377 |
| 6,250,531 | B1 * | 6/2001 | Yagi | 227/79 |
| 7,159,749 | B2 * | 1/2007 | Tsai | 227/155 |
| 7,195,141 | B2 * | 3/2007 | Elonsson et al. | 227/79 |
| 7,396,008 | B2 * | 7/2008 | Sato et al. | 270/58.09 |
| 2007/0034665 | A1 * | 2/2007 | Shimizu et al. | 227/155 |
| 2008/0223899 | A1 * | 9/2008 | Kishi et al. | 227/79 |

FOREIGN PATENT DOCUMENTS

| | | |
|---|---|---|
| EP | 0 051 395 A2 | 5/1982 |
| EP | 0 266 700 A2 | 5/1988 |
| JP | Y-03-025931 | 6/1991 |
| JP | 10-128683 | 5/1998 |
| JP | 2001-105347 | 4/2001 |

* cited by examiner

*Primary Examiner*—Sameh H. Tawfik
*Assistant Examiner*—Michelle Lopez
(74) *Attorney, Agent, or Firm*—Morgan, Lewis & Bockius LLP

(57) ABSTRACT

A cut chip of a staple leg cut by a cutter unit is discharged to a lower face side of the cutter unit by way of an opening formed at the cutter unit. The cut chip is guided in directions of both sides of the stapler by a pair of chutes arranged on a lower face side of the cutter unit to be continuous to the opening portion. The cut chip guided by the chutes is guided to a containing portion formed at a rear lower portion of the stapler by way of guide case portions formed at both side faces of the stapler.

7 Claims, 7 Drawing Sheets

STAPLER WITH A MECHANISM FOR CUTTING STAPLE LEGS

TECHNICAL FIELD

The present invention relates to a stapler including a cutter unit for cutting a tip portion of a staple leg projected to a face of sheets on an opposed side by penetrating the sheets when binding sheets having different thicknesses by the stapler, particularly relates to a stapler including a staple leg cut chip processing apparatus for preventing a cut chip of a staple leg cut by the cutter unit from being scattered to inside of the stapler.

BACKGROUND ART

In a kind of a stapler for bundling to bind together a plurality of sheets of paper included in a printer, a copier or the like and subjected to a processing of printing, copying or the like, there is provided a cutter unit for cutting a tip portion of a staple leg penetrated to a back-face side of sheets in order to deal with a variation in a number of sheets of paper. By the cutter unit, thin sheets through thick sheets can be bound by a stable shape by making a length of the staple leg projected from the sheets constant. The cutter unit is constituted by a fixed cutter and a movable cutter made to be moved relative to the fixed cutter. According to the staple leg advanced to between the two cutters by penetrating the sheets, a tip portion of the staple leg is cut such that the length of the staple leg portion of the penetrated portion from the sheets become substantially constant.

According to the stapler having such a cutter unit for cutting the tip portion of the staple leg, there is a case of posing a problem that the cut chip of the staple leg cut by the cutter unit is scattered at inside of the stapler and is caught by an operating mechanism of a drive gear, a link or the like to bring about an operation barrier, or dropped onto a circuit board to short circuit to destruct the circuit. Therefore, according to a stapler disclosed in JP-Y-03-025931, there is provided a cut chip processing apparatus for preventing a cut chip from being scattered to inside of a stapler by accumulating the cut chip of staple leg cut by the cutter unit to a predetermined portion. According to the apparatus of processing the cut chip of the staple leg, a containing vessel for containing the cut chip is inclined to be arranged at a discharge portion for discharging the cut chip of the staple leg from the cutter unit, an opening portion is formed at a lower end of the containing vessel, the opening portion is provided with a closed lid member operated by a gravitational force to close the opening portion at normal time, and the cut chip stored in the containing vessel can be discharged to outside.

However, according to a stapler included in a printer, a copier or the like, arranged along a path of carrying sheets at inside of the apparatus and binding together printed or copied sheets, there is a case in which sheets in a state of being in a horizontal or in a vertical direction or inclined by other arbitrary angle are bound together, or in order to bind together sheets at arbitrary plural portions, the stapler is operated while being rotated in a 45 degrees direction on a plane having an angle of elevation. In the staple leg cutting chip processing apparatus according to JP-y-03-025931, the containing vessel mounted to a portion of discharging the cut chip from the cutter unit is mounted on a front side of the stapler, the opening/closing lid portion for closing the opening portion formed at the lower end portion of the containing vessel is operated by the gravitational force and therefore, when, for example, the stapler is installed to direct in the vertical direction to bind together sheets substantially in a vertical state, the cut chip is not discharged to inside of the containing vessel, further, the lower end opening portion is not closed by the opening/closing unit member but is opened in being operated. Therefore, the stapler cannot be installed to direct in a number of directions.

DISCLOSURE OF THE INVENTION

In accordance with one or more embodiments of the invention, a stapler is provided with an apparatus of processing a cut chip of a staple leg capable of guiding the cut chip of the staple leg firmly to a containing portion even when the stapler is installed in either of directions of binding a sheet in a horizontal state and in a vertical state, further, even when a stapler is operated to pivot in 45 degrees direction on a plane having an angle of elevation.

Further, in accordance with one or more embodiments of the invention, a stapler is provided with a strike mechanism portion for striking out a staple to a sheet, a clincher mechanism portion supported to be able to be operated to be proximate and remote to and from the strike mechanism portion for folding to bend a staple leg along a back face of the sheet, and a cutter unit formed at inside of the clincher mechanism portion for cutting a tip portion of the staple leg projected to a back face side of the sheet. The cutter unit is constituted by a fixed cutter member and a movable cutter capable of being moved relative to the cutter member, a cut chip of the staple leg cut by the cutter unit is discharged to a lower face side of the cutter unit by way of an opening portion formed at the cutter unit, the cut chip is guided to both sides of the stapler by a pair of chutes arranged on a lower face side of the cutter unit to be continuous to the opening portion and the cut chip guided by the chutes is guided to a containing portion formed at a rear lower portion of the stapler by way of guide case portions formed at both side faces of the stapler.

Further, in accordance with one or more embodiments of the invention, the containing portion formed at the rear lower portion of the stapler is formed with a discharge port opened to the lower face side of the containing portion, the discharge port is formed with an opening/closing lid capable of being operated between a close position for closing the discharge port and an open position for opening the discharge port, and the cut chip accumulated at inside of the containing portion is discharged by opening the opening/closing lid.

Further, in accordance with one or more embodiments of the invention, in order to firmly guide the cut chip of the staple leg to the containing portion even when the stapler is installed to bind also a sheet in either of a horizontal state or in a vertical state, further, even when the stapler is operated to rotate in 45 degrees direction on a plane having an angle of elevation, the cutter unit is constituted by the fixed cutter member and the movable cutter movable relative to the fixed cutter member, the cut chip of the staple leg cut by the cutter unit is discharged to the lower face side of the cutter unit by way of the opening formed at the cutter unit, the cut chip is guided to the both sides of the stapler by the pair of chutes arranged on a lower face side of the opening to be continuous to the opening, and the cut chip guided by the chutes is guided to the containing portion formed at the rear lower portion of the stapler by way of the guide case portions formed at the both side faces of the stapler.

Further, in accordance with one or more embodiments of the invention, a stapler is provided with a cutter unit including a fixed cutter member and a movable cutter movable relative to the fixed cutter member for cutting a tip portion of a staple leg projected to a back face side of a sheet, an opening portion formed at the cutter unit, a pair of chutes arranged on a lower face side of the cutter unit to be continuous to the opening portion, and a containing portion formed at a lower portion of the stapler.

In accordance with one or more embodiments of the invention, the stapler is further provided with a guide case portion, wherein the cut chip of the staple leg cut by the cutter unit is discharged to a lower face side of the cutter unit by way of the opening portion and is guided to both sides of the stapler by the chutes, and the cut chip guided by the chutes is guided to the containing portion by way of the guide case portion.

In accordance with one or more embodiments of the invention, the guide case portions are formed at both side faces of the stapler, and the containing portion is formed at a rear lower portion of the stapler.

In accordance with to one or more embodiments of the invention, the stapler is further provided with a strike mechanism portion for striking out a staple to the sheet, and a clincher mechanism portion operated to be proximate to and remote from the strike mechanism portion for folding to bend the staple leg penetrated through the sheet along the back face of the sheet, wherein the cutter unit is formed at inside of the clincher mechanism portion.

In accordance with one or more embodiments of the invention, the stapler is further provided with a discharge port formed at the containing portion and opened to a lower face side of the containing portion, and an opening/closing lid capable of being operated between a close position for closing the discharge port and the opening position opening the discharge port.

In accordance with one or more embodiments of the invention, the opening/closing lid is urged in a direction of closing the discharge port.

In accordance with one or more embodiments of the invention, the stapler further comprises an operating portion for operating the opening/closing lid to open the discharge port against a direction of urging the opening/closing lid.

Other aspects and advantages of the invention will be apparent from the following description and the appended claims.

DESCRIPTION OF REFERENCE NUMERALS AND SIGNS

Figure 1:
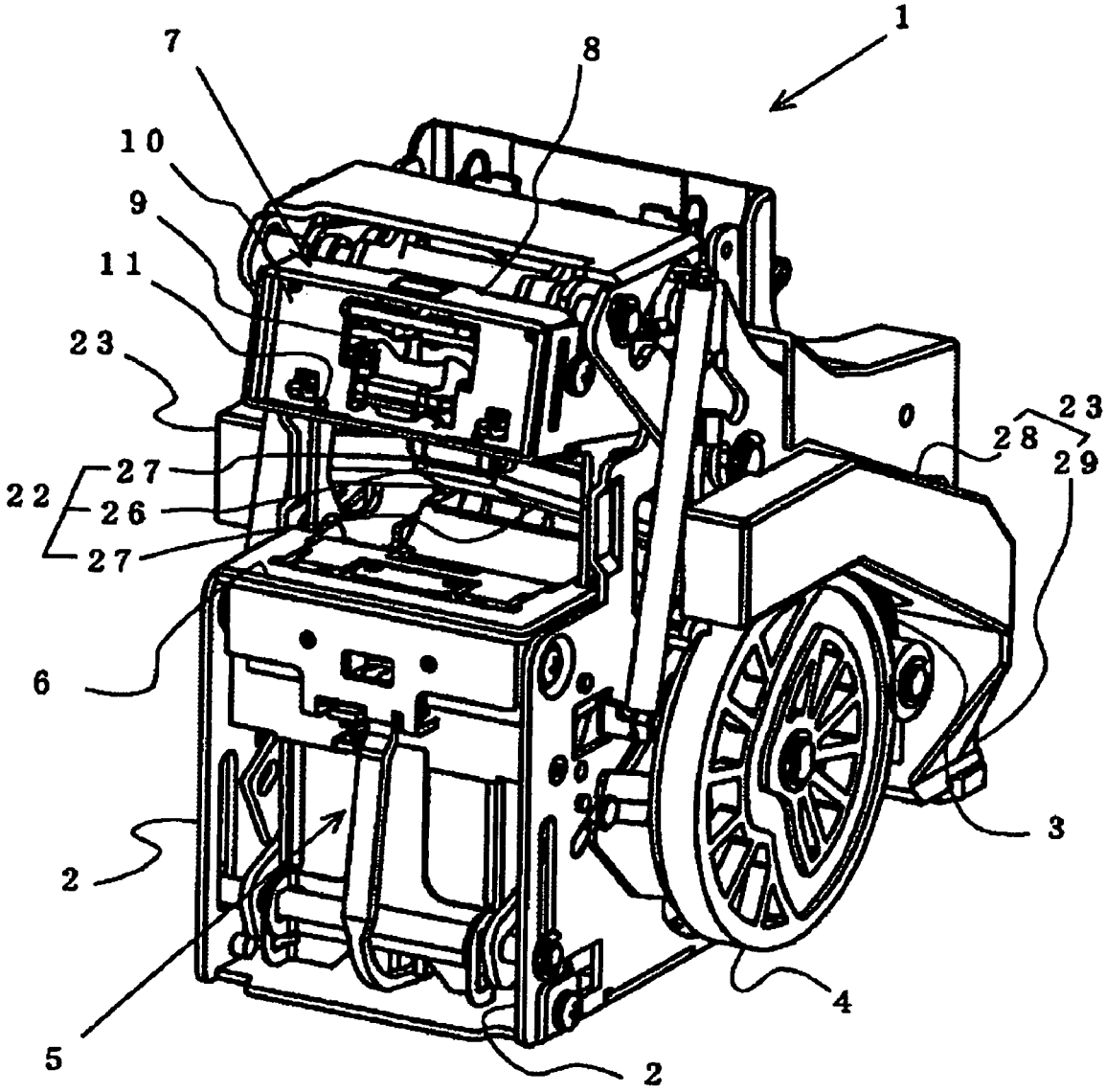
FIG. 1 is a perspective view of a stapler including a staple leg cut chip processing apparatus according to one or more embodiments of the invention.

1 . . . stapler
5 . . . strike mechanism portion
7 . . . clincher mechanism portion
12 . . . cutter unit
13 . . . fixed cutter
16 . . . movable cutter
21 . . . discharge portion
22 . . . chute
23 . . . cut chip containing portion
28 . . . guide case portion
29 . . . containing portion

BEST MODE FOR CARRYING OUT THE INVENTION

One or more embodiments of the invention will be explained in reference to the drawings as follows.

Embodiment 1

Figure 2:
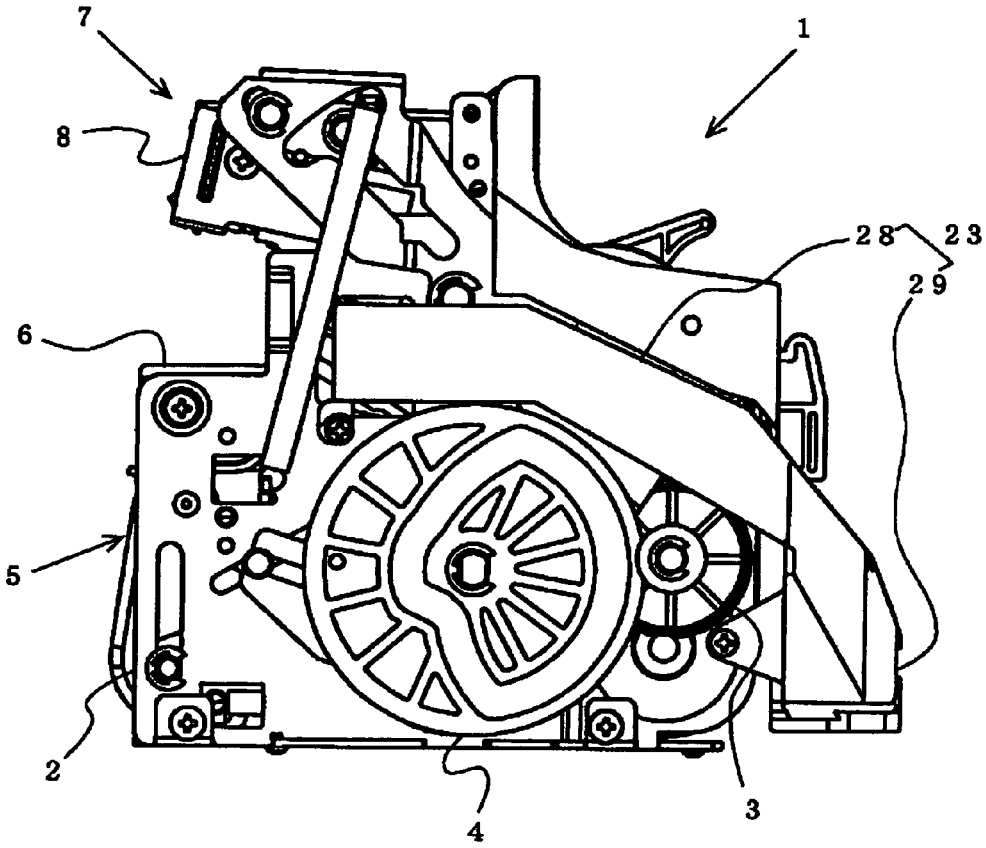
FIG. 2 is a side view of a stapler the same as that of FIG. 1.

FIG. 1 and FIG. 2 show the stapler 1 according to one or more embodiments of the invention. The stapler 1 is a built-in type stapler for binding together a plurality of sheets of paper subjected to a processing of printing, copying or the like at inside of a printer, a copier or the like. There is a case in which the stapler 1 is installed by a predetermined angle of elevation of 0 degree through 80 degrees (less than 90 degrees) at inside of a printer, a copier or the like in accordance with an inner layout situation of the printer, the copier or the like. An angle of elevation of 0 degree indicates a situation in which the stapler 1 is horizontally arranged for binding sheets laminated horizontally. An angle of elevation of 90 degrees indicates a situation in which the stapler 1 is arranged vertically for binding sheets laminated vertically. Further, the stapler 1 is pivoted in a range of an azimuth of ±45 degrees on a plane having the predetermined angle of elevation. When binding is carried out by the azimuth of 0 degree, a crown portion of a staple and a sheet end piece become in parallel with each other. Further, when a corner portion of the sheet is bound, binding is carried out by an azimuth of +45 degrees or −45 degrees. An electric motor 3 is arranged at inside of a machine frame 2 forming an outer contour of the stapler 1, further, a side face of the machine frame 2 is arranged with a drive cam 4 driven to rotate by the electric motor 3. A lower portion of the machine frame 2 is formed with the strike mechanism portion 5 driven by the drive cam 4 for striking out a staple formed in a C-shape to a sheet. Further, the machine frame 2 is formed with a table 6 and a staple is struck in an upper direction from a lower plate side of the table 6 to a sheet arranged above the table 6 by the strike mechanism portion 5.

Figure 3:
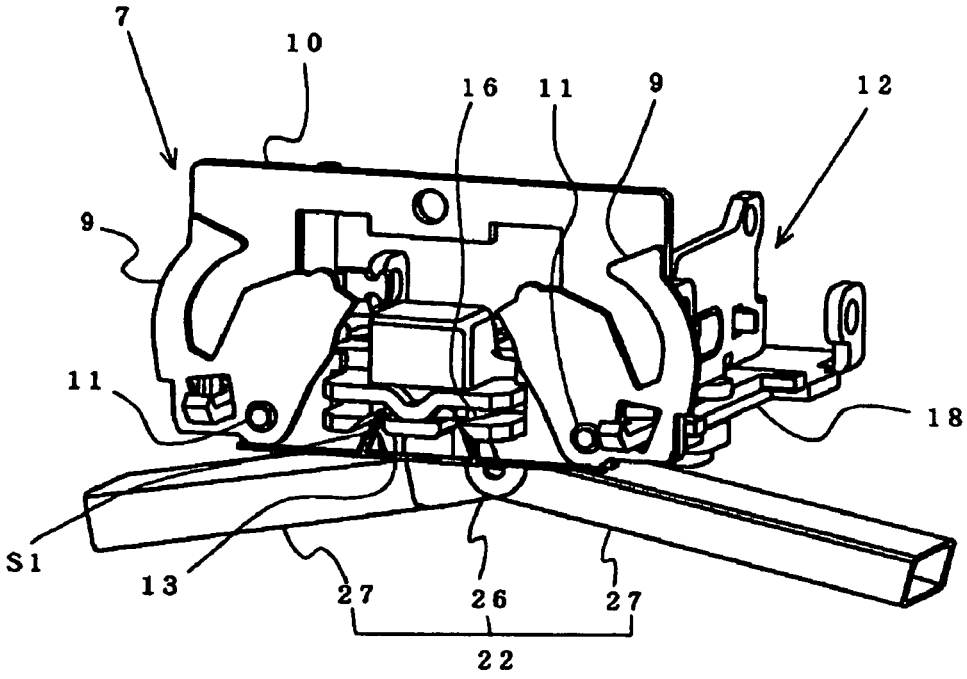
FIG. 3 is a perspective view showing an essential portion of a clincher mechanism portion in the stapler of FIG. 1.

An upper portion of the machine frame 2 is formed with the clincher mechanism portion 7 for folding to bend a staple leg struck by the strike mechanism portion 5 and penetrated to an upper face side of the sheet arranged above the table 6 along the upper face of the sheet. The clincher mechanism portion 7 includes a clincher frame 8 a rear end portion of which is pivotably supported by the machine frame 2, and the clincher frame 8 is operated to pivot to pinch the sheet between the upper face of the table 6 and the clincher frame 8 after arranging the sheet above the table 6. As shown by FIG. 1 and FIG. 3, the clincher mechanism portion 7 is provided with a pair of movable clinchers 9 to be engaged with the staple legs penetrated through the sheet to be projected to the upper face side of the sheet for bending the staple legs along the upper face of the sheet at support plates 10 mounted to a front end portion of the clincher frame 8 respectively pivotably relative to a pivoting shaft 11.

Figure 4:
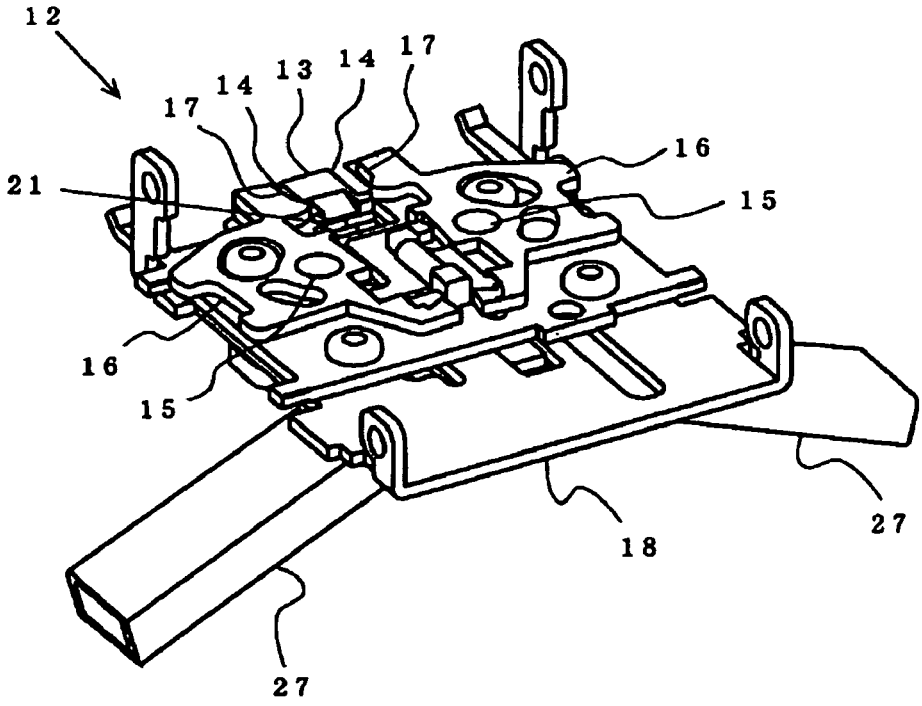
FIG. 4 is a perspective view showing a cutter unit in the stapler of FIG. 1.

Further, the clincher mechanism portion 7 is formed with the cutter unit 12 for cutting a tip portion of the staple leg to make a length of a portion projected from the sheet of the staple leg penetrated through the sheet a constant length. As shown by FIG. 4, the cutter unit 12 is constituted by a fixed cutter 13 a front end portion of which is formed with a cut edge 14 arranged between a pair of the staple legs penetrated through the sheet and projected to the upper face side of the sheet, and a pair of the movable cutters 16 pivotably supported centering on pivoting shafts 15 in a state of being brought into close contact with an upper face of the fixed cutter 13, front ends of the pair of respective movable cutters 16 are formed with cut edges 17 opposed to the cut edges 14 of the fixed cutter 13, and with regard to the staple legs arranged between the respective cut edges 14, 17, lengths of the staple legs projected to the upper face of the sheet are made constant by cutting tip portions of the staple legs between the two cut edges 14, 17 by pivoting the movable cutters 16 to operate the cut edges 17 from an outer side to inner side of the pair of staple legs centering on the pivoting shafts 15.

The fixed cutter 13 in a plate-like shape forming the cutter unit 12 is slidably supported by an upper face of a support base 18 formed on a rear side of a support plate 10 for supporting the movable clinchers 9, as shown by FIG. 3, when the movable clinchers 9 are pivoted to standby positions, portions of the cut edges 14, 17 are arranged at front positions opposed to the staple struck out from the strike mechanism 3, and the staple legs advancing between the cut edges 14, 17 by penetrating the sheet are cut by pivoting the movable cutters 16 relative to the fixed cutter 13 at the positions. Further, after cutting the staple legs S1, as shown by FIG. 5, the cutter unit 12 is moved to slide to a rear side above the support base 18 to escape from a region of operating the movable clinchers 9, thereby, the staple legs are bent along the back face of the sheet to be bound by the staple without interfering the movable clinchers 9 with the cutter unit 12.

The stapler 1 is formed with a cut chip processing apparatus for preventing a cup chip brought about in cutting the staple legs by the cutter unit 12 from being scattered to inside of the stapler 1. The cut chip processing apparatus is constituted by the opening portion 21 for discharging the cut chip cut by the cutter unit 12 to a lower face side of the cutter unit 12, the chutes 22 for guiding the cut chip discharged to the lower face side of the cutter unit 12 by way of the opening portion 21 to two side faces of the stapler 1, and the cut chip containing portions 23 for guiding the cut chip guided to the two guide faces of the stapler 1 along two side faces of the machine frame 2 of the stapler 1 to be accumulated to be contained at the lower portions of the stapler 1.

The opening portion 21 for discharging the cut chip to the lower face side of the cutter unit 12 is constituted by an opening 24 formed at the fixed cutter 13 in the plate-like shape to penetrate to a lower face side from an upper face side of the fixed cutter 13, and an opening 25 formed at the support base 18 for slidably supporting the fixed cutter 13 to penetrate to a lower face side from an upper face side of the support base 18. An inclined face 24*a* is formed at an edge on a front side of the opening 24 formed at the fixed cutter 13, and the cut chip cut by operating the movable cutters 16 is guided to inside of the opening 24 by the inclined face 24*a*. By sliding to operate the cutter unit 12 arranged at a front position shown in FIG. 3 and FIG. 4 for cutting the staple legs to the rear side shown in FIG. 5 and FIG. 6 after cutting the staple legs, the opening 24 of the fixed cutter 13 and the opening 25 of the support base 18 are matched, and the cut chip cut by pivoting the movable cutters 16 is discharged to the lower face side of the cutter unit 12 by way of the two openings 24, 25.

Figure 5:
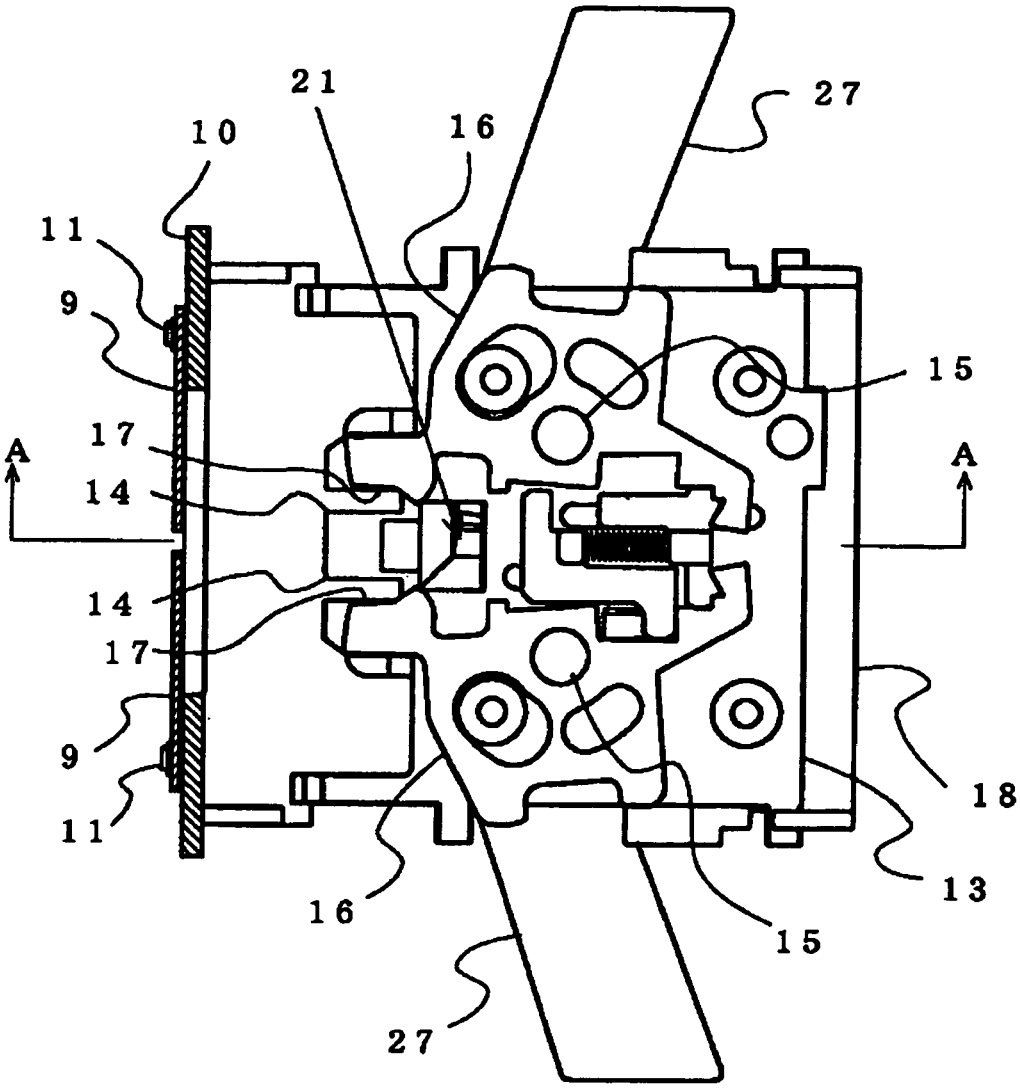
FIG. 5 is a plane view showing a cutter unit the same as that of FIG. 4 operated to an escape position on a rear side.
Figure 6:
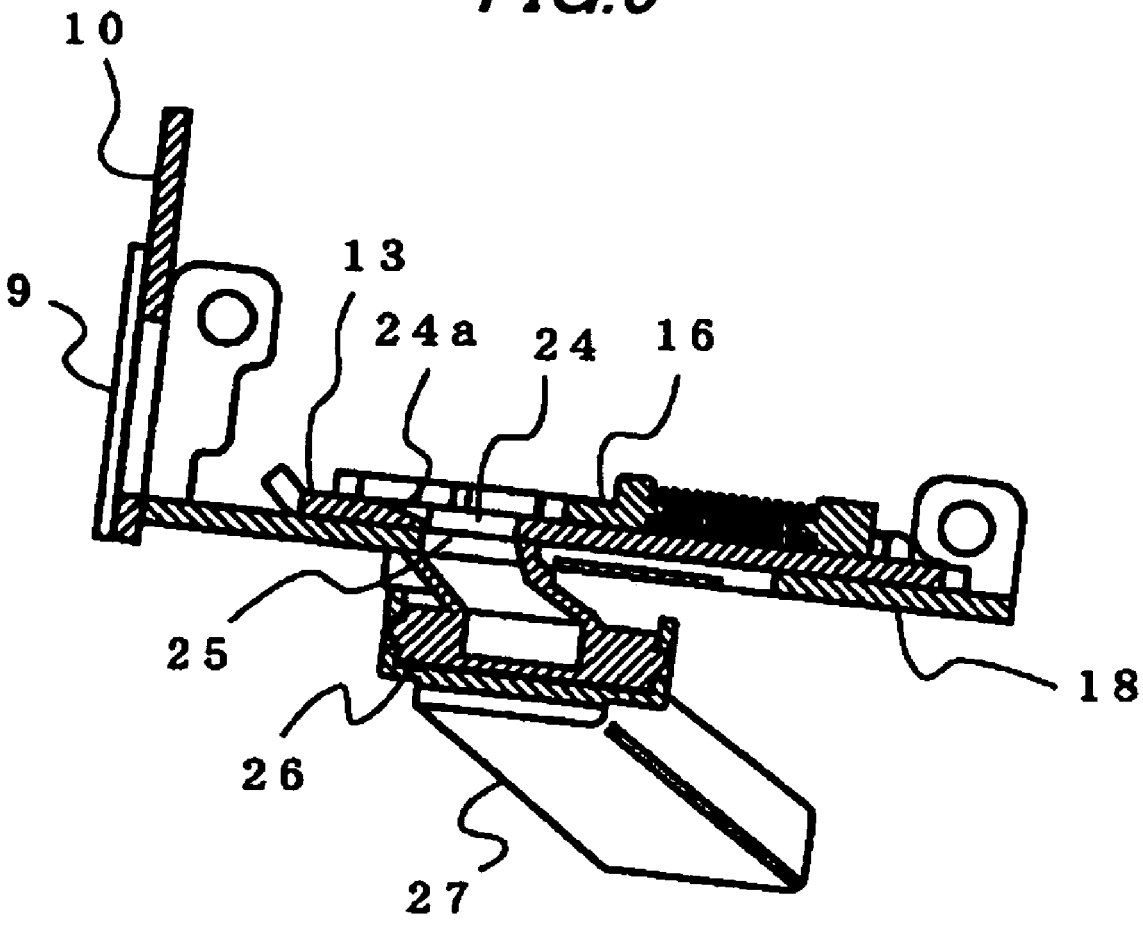
FIG. 6 is a sectional view taken along a line A-A of FIG. 5.

The chutes 22 for guiding the cut chip discharged to the lower face side of the cutter unit 12 in directions of two side faces of the stapler each 1 is constituted by a first chute 26 mounted to a back face of the support base 18 to cover the lower face side of the opening 25 formed at the support base 18, and a pair of second chute members 27 respective one end sides of which are respectively supported pivotably by the first chute member 26 and other end sides of which are arranged on outer sides of the side faces of the machine frame 2 of the stapler 1, as shown by FIG. 3 through FIG. 5, the pair of the second chute members 27 are symmetrically formed in both sides directions relative to a center line of the stapler 1, and even when a direction of installing the stapler 1 is constituted by any direction, the cut chip can be discharged to be guided in a direction of either of the side faces of the stapler 1.

Figure 7:
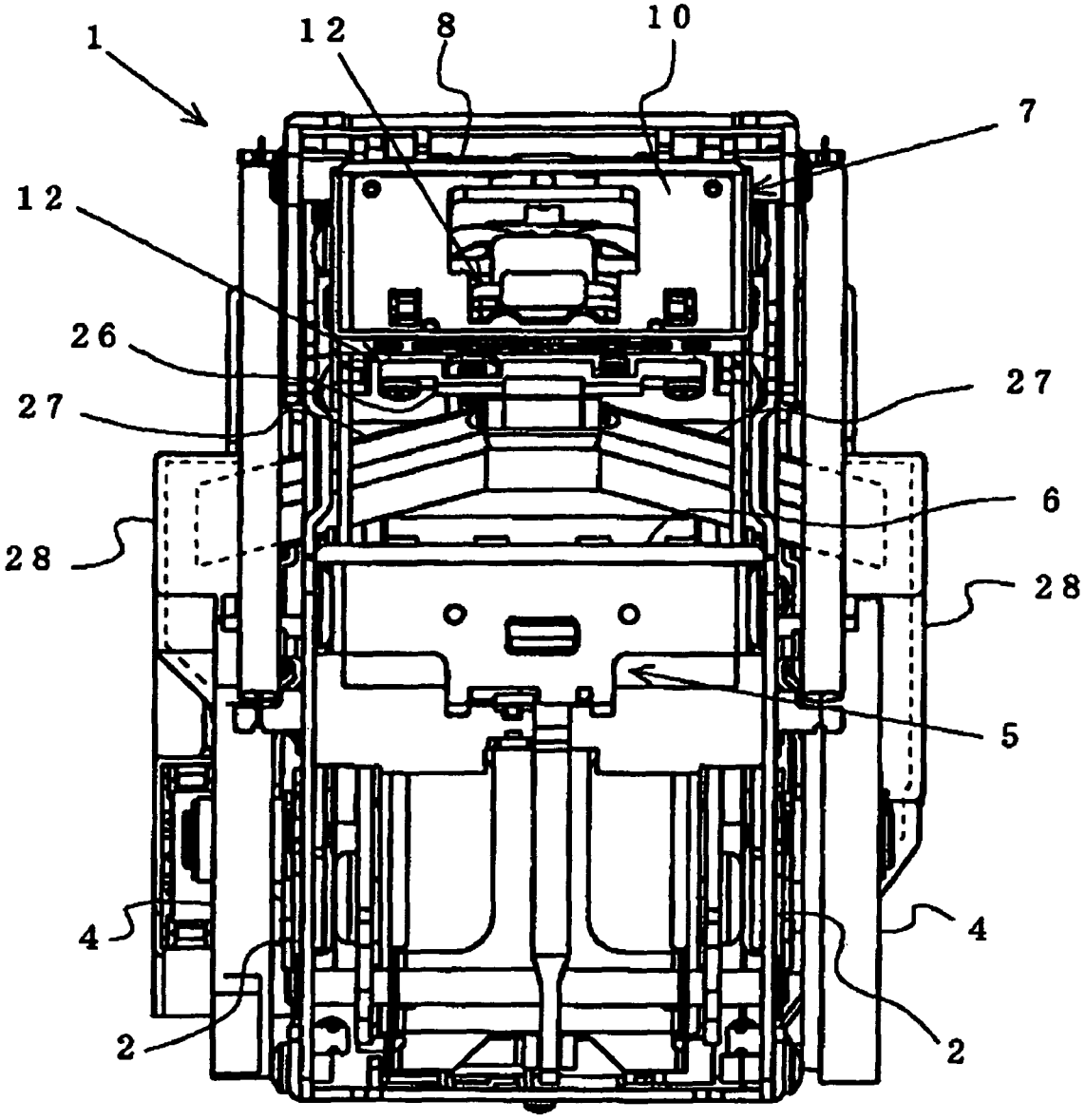
FIG. 7 is front view of a stapler the same as that of FIG. 1.
Figure 8:
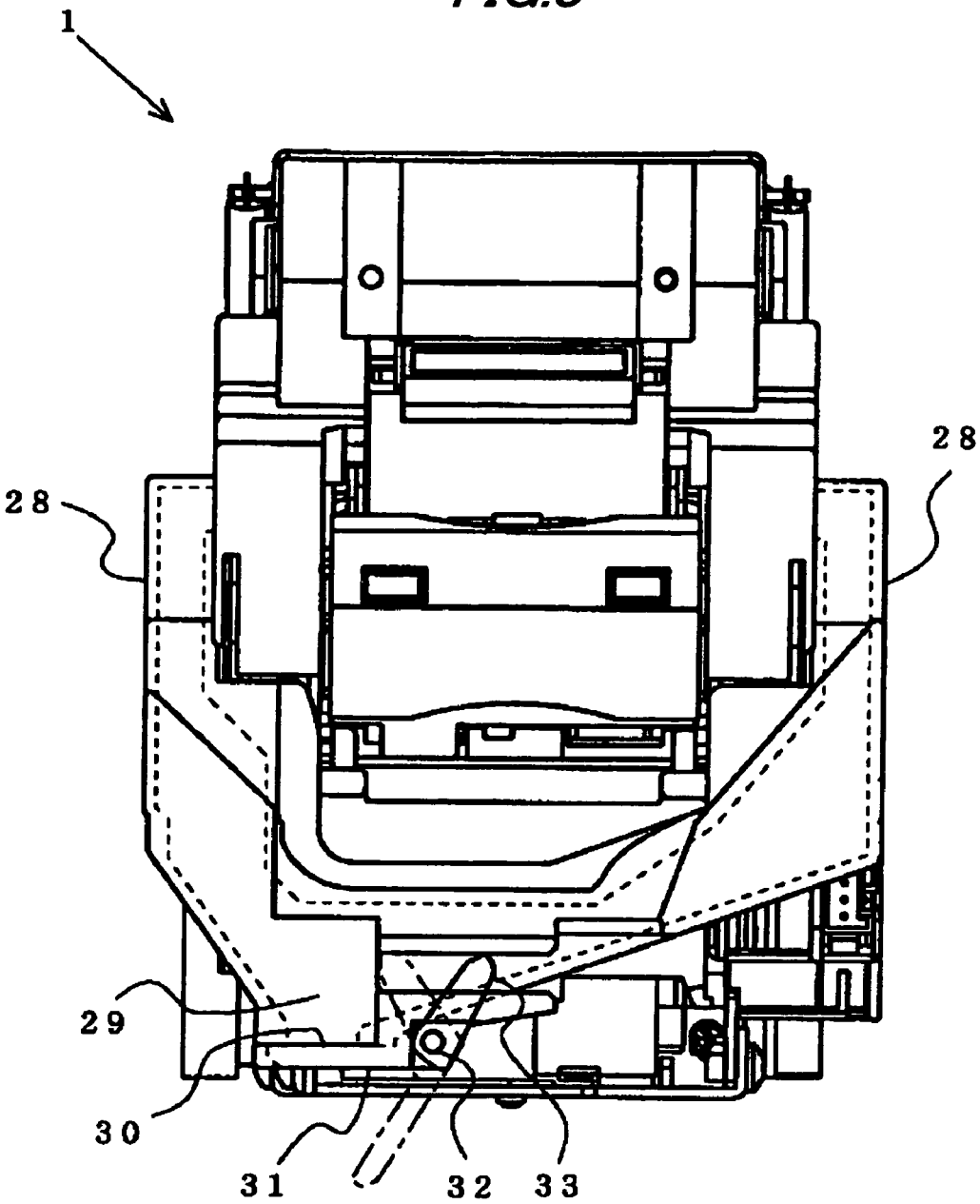
FIG. 8 is a rear view of a stapler the same as that of FIG. 1.

As shown by FIG. 2 and FIG. 8, side faces of the machine frame 2 of the stapler 1 are formed with the cup chip containing portions 23 for containing the cut chip guided to the side faces of the machine frame 2 by the second chute members 27. The cut chip containing portions 23 are formed by a pair of guide case portions 28 arranged along respective outer sides of the machine frame 2 arranged on both sides of the stapler 1, and the containing portion 29 formed continuous to the guide case portions 28, and the pair of guide case portions 28 and the containing portion 29 are integrally formed substantially in a hollow shape by a plastic member or the like. As shown by FIG. 7, respective end portions of the pair of second chute members arranged on the outer sides of the machine frame 2 are inserted to be arranged at inside of the guide case portions 28, and the cut chip discharged by way of the second chute members 27 is guided to insides of the guide case portions 28. The containing portion 29 is formed to be arranged on a rear lower side of the stapler 1, and the cut chip guided into the guide case portions 28 is stored at inside of the containing portion 29.

As shown by FIG. 8, a lower portion of the containing portion 29 forming the cup chip containing portion 23 is formed with a discharge port 30 for discharging the cut chip stored at inside of the containing portion 29, the discharge port 30 is formed to direct to a lower side from a position of a lower end of the containing portion 29, and the discharge port 30 is mounted with a lid member 31 (opening/closing lid 31) pivotably supported by a support shaft 32 to close or open the discharge port 30. The lid member 31 is urged by a spring or the like, not illustrated, to close the discharge port 30 at normal time, and is pivoted to open the discharge port 30 by operating an operating portion 33 integrally formed with the lid member 31 as indicated by a chain line in the drawing to be able to discharge the cut chip at inside of the containing portion 29 to outside.

As described above, according to the cut chip processing apparatus of the staple leg according to the embodiment, the cut chip of the staple leg brought about by cutting the staple leg by the cutter unit 12 is discharged to the lower face side of the cutter unit 12 by way of the opening 24 formed on the rear side of the cut edge 14 of the fixed cutter 13, and the opening 25 formed at the support base 18 for slidably supporting the cutter unit 12, the cut chip is guided to the guide case portions 28 formed on the both sides of the stapler 1 by guiding the cut chip by the chutes 22 formed at the lower face of the support base 18, and is collected to inside of the containing portion 29 formed at the rear lower portion of the stapler 1 by way of the guide case portions 28 and therefore, the cut chip of the staple leg cut by the cutter unit 12 can be prevented from advancing to a gap of a mechanism of driving or a part of operating the stapler 1 to bring about an operational barrier or the like at the drive mechanism or the like.

Further, the cut chip discharged to the lower face side of the cutter unit 12 is guided to insides of the guide case portions 28 formed on the both sides of the stapler 1 by way of the first chute member 26 formed on the lower face side of the cutter unit 12 and the pair of the second chute members 27 connected pivotably to the first chute member 26 and therefore, even when a main body of the stapler 1 is installed in a horizontal direction or in a vertical direction to be able to bind together sheets arranged in a horizontal direction or a vertical direction at inside of the apparatus including the stapler 1, further, even when the stapler 1 is operated to rotate in 45 degrees direction on a plane having an angle of elevation, the cut chip can be discharged to inside of the containing portion 29 by way of the guide case portions 28 by guiding the cut chip in a direction of either of the side faces of the stapler 1 by way of the pair of the second chute members 27 and can be included in a number of kinds of copiers or the like.

While the invention has been described in detail with reference to the specific embodiments, it will be apparent to those skilled in the art that various modifications and variations can be made without departing from the spirit or scope of the invention.

The application is based on Japanese Patent Application (Japanese Patent Application No. 2004-212338) filed on Jul. 20, 2004 and contents of which are incorporated herein by reference.

INDUSTRIAL APPLICABILITY

According to one or more embodiments of the invention, the cutter unit is constituted by a fixed cutter member and a movable cutter movable relative to the fixed cutter member, a cut chip of a staple leg cut by the cutter unit is discharged to a lower face side of the cutter unit by way of an opening portion formed at the cutter unit, the cut chip is guided to both sides of the stapler by a pair of chutes arranged on the lower face side of the cutter unit to be continuous to the opening portion, the cut chip guided by the chutes is guided to a containing portion formed at a rear lower portion of the stapler by way of guide case portions formed at both side faces of the stapler and therefore, even when a main body of the stapler is installed in a horizontal direction or in a vertical direction to bind together sheets arranged in a horizontal direction or in a vertical direction, further, even when the stapler is operated to pivot in 45 degrees direction on a plane having an angle of elevation, the cut chip can be guided to be discharged to inside of the containing portion by way of the guide case portions installed at the both side faces of the stapler by guiding the cut chip in directions of the both side faces of the stapler by way of the pair of chutes, and the stapler can be included in various kinds of copiers or the like.

Further, according to one or more embodiments of the invention, the containing portion formed at the rear lower portion of the stapler is formed with a discharge port opened to the rear face side of the containing portion, the discharge port is formed with an opening/closing lid capable of being operated between a close position for closing the discharge port and an open position for opening the discharge port, the cut chip accumulated at inside of the containing portion can be discharged by opening the opening/closing lid and therefore, the cut chip stored at inside of the containing portion can easily be discharged from inside of the chip containing portion to outside, and the cut chip stored at inside of the containing portion can easily be processed.

The invention claimed is:

1. A stapler comprising:

a cutter unit including a fixed cutter member and a movable cutter member that is movable relative to the fixed cutter member to cut a tip portion of a staple leg projected from a back face side of a sheet;

an opening portion formed at the cutter unit;

a pair of chutes arranged on a lower face side of the cutter unit that connects to the opening portion, the pair of chutes being symmetrically formed in both sides directions relative to a center line of the stapler;

a containing portion formed at a rear lower portion of the stapler to collect the tip portion of the staple leg being cut; and guide case portions, wherein the tip portion of the staple leg cut by the cutter unit is discharged to the lower face side of the cutter unit by way of the opening portion and is guided to both sides of the stapler by the chutes, and wherein the tip portion guided by the chutes is guided to the containing portion by way of the guide case portions, wherein the tip portion is discharged to the lower face side of the cutter unit by way of the opening portion, and wherein the guide case portions are formed at both side faces of the stapler.

2. The stapler according to claim 1, further comprising:

a strike mechanism portion to strike a staple to the sheet; and a clincher mechanism portion operated to be proximate to and remote from the strike mechanism portion for folding to bend the staple leg penetrated through the sheet along the back face of the sheet, wherein the cutter unit is formed at inside of the clincher mechanism portion.

3. The stapler according to claim 1, further comprising:

a discharge port formed at the containing portion and opened to a lower face side of the containing portions; and an opening/closing lid capable of being operated between a close position for closing the discharge port and the opening position opening the discharge port.

4. The stapler according to claim 3, wherein the opening/closing lid is urged in a direction of closing the discharge port.

5. The stapler according to claim 4, further comprising:

an operating portion for operating the opening/closing lid to open the discharge port against a direction of urging the opening/closing lid.

6. The stapler according to claim 1, wherein the fixed cutter member has an inclined face formed at an edge of the opening portion such that a cut tip portion of the staple leg is guided to the pair of chutes over the inclined face.

7. A stapler comprising:

a cutter unit including a fixed cutter member and a movable cutter member that is movable relative to the fixed cutter member to cut a tip portion of a staple leg projected from a back face side of a sheet;

an opening portion formed at the cutter unit;

a pair of chutes arranged on a lower face side of the cutter unit that connects to the opening portion, the pair of chutes being symmetrically formed in both sides directions relative to a center line of the stapler;

a containing portion formed at a rear lower portion of the stapler to collect the tip portion of the staple leg being cut; and a support board for slidably supporting the cutter unit, wherein the tip portion is discharged to the lower face side of the cutter unit by way of the opening portion, wherein the opening portion includes a first opening formed at the fixed cutter member and a second opening formed at the support board, and the first opening is matched with the second opening by sliding movement of the cutter unit with respect to the support board, and wherein the tip portion is discharged to the pair of chutes by way of the matched first and second openings.

* * * * *